US005628653A

United States Patent [19]

Haas et al.

[11] Patent Number: 5,628,653

[45] Date of Patent: May 13, 1997

[54] SHIELDED MODULAR ADAPTER

[75] Inventors: Orville A. Haas, Pocahontas, Ark.; Edward A. Karale, Fremont, Calif.

[73] Assignee: Regal Electronics, Inc., Santa Clara, Calif.

[21] Appl. No.: 614,092

[22] Filed: Mar. 12, 1996

[51] Int. Cl.[6] ..... H01R 13/648

[52] U.S. Cl. ..... 439/607; 439/676; 439/638

[58] Field of Search ..... 439/359, 362, 439/607–609, 638, 676, 701; 29/842

[56] References Cited

U.S. PATENT DOCUMENTS

| | | | |
|---|---|---|---|
| 5,158,480 | 10/1992 | Bloondeel et al. | 439/607 |
| 5,169,346 | 12/1992 | Johnston | 439/676 |
| 5,195,911 | 3/1993 | Murphy | 439/607 |
| 5,207,597 | 5/1993 | Kline et al. | 439/607 |
| 5,228,872 | 7/1993 | Liu | 439/607 |
| 5,281,169 | 1/1994 | Kiat et al. | 439/607 |
| 5,312,273 | 5/1994 | Andre et al. | 439/607 |
| 5,326,281 | 7/1994 | Yin | 439/607 |
| 5,378,172 | 1/1995 | Roberts | 439/607 |
| 5,382,182 | 1/1995 | Shen et al. | 439/676 |
| 5,397,250 | 3/1995 | Briones | 439/620 |

OTHER PUBLICATIONS

Chris J. Georgopoulos, "Interference Control in Cable and Device Interfaces", 1988, pp. 89–90, 128–131.

Ralph Morrison, "Grounding and Shielding Techniques in Instrumentation", 1967, pp. 24–25, 32–33.

Harry Hazzard, Richard Kiefer, "EMI reduction starts with connector doubling as low pass filter", Mar. 14, 1985, Electronic Design, pp. 181–186.

*Primary Examiner*—Khiem Nguyen

*Attorney, Agent, or Firm*—Thomas E. Schatzel; Law Offices of Thomas E. Schatzel, A Prof. Corporation

[57] ABSTRACT

A shielded modular adapter adapts one type of connector to another and provides electromagnetic shielding therein in order to reduce radio frequency interference and adjacent signal line interference. The shielded modular adapter may include electromagnetic filters to further reduce electromagnetic radiation. Additionally, the shielded modular adapter is user programmable or selectable by inserting pins into the appropriate holes within a connector and snapping the connector in place.

20 Claims, 3 Drawing Sheets

SHIELDED MODULAR ADAPTER

BACKGROUND OF THE INVENTION

1. Field of the Invention

The present invention relates generally to cable adapters, and more particularly it relates to modular adapters.

2. Description of the Prior Art

In order that terminals or computer systems could have the capability of communicating with each other and other computer equipment, local area networks (LANs) were introduced so that terminals, computer systems, and other computer equipment could communicate within the same building. The type of local area network (LAN) used differed depending upon the speed, costs and the capability of wiring the terminals, computer systems, and equipment together.

One type of LAN was a token ring that utilized a continuous coaxial transmission cable that was configured as a ring. Male and female BNC connectors were used to couple the ring together. A T-connector or tap was inserted within the ring so that the various computer equipment could communicate with signals on the token ring. While a token ring provided fast communication, it was difficult to expand and any break in the ring caused the entire LAN to be inoperable.

Another type of LAN, referred to as ethernet, was introduced. An ethernet LAN provided for flexibility such that additional computers, other computer equipment, or other network equipment such as bridges, routers, or repeaters could be easily added. Failures in a portion of an ethernet LAN were more tolerated such that the entire network would not be disrupted. Initially, an ethernet LAN required routing expensive cabling throughout a building. To lower the costs of installing an ethernet, a 10BASE-T ethernet LAN was introduced which utilized modular connectors and cabling similar to modular telephone cables. A 10BASE-T ethernet simply required the use of eight twisted wire conductors or the equivalent of two four conductor telephone cables. A 10BASE-T ethernet was inexpensive and allowed a company to pre-wire an entire building for a LAN.

In order to connect the terminals, computer systems, and other computer equipment to the ethernet, connectors were necessary. The male connector used at an end of 10BASE-T cable was a modular plug referred to as an RJ-45 plug. A female connector used to receive the male RJ-45 plug was a modular jack referred to as an RJ-45 jack. The RJ-45 jack was not initially built into most terminals or computer systems because it was unknown what type of LAN connection would be used and it was prohibitively expensive to provide a connector for every type of LAN connection. Thus computer equipment manufacturers typically utilized a female D-type connector to provide a connection to the LAN interface electronics of the computer system. In order to couple the female D-type connector to a LAN connector, an adapter was required. In the case of 10BASE-T ethernet LAN, a modular adapter was introduced that converted an RJ-45 plug to a male D-type connector which could be plugged into a female D-type connector. The modular adapter also became useful in connecting modems, printers, and other peripheral components to the computer itself via the serial ports such as an RS-232 port or parallel ports.

With the increase in the number of computer systems, other computer equipment, and network equipment that was attached to the ethernet LAN, the communication over the ethernet became slower. In order to increase the speed of communication over the ethernet LAN, new communication standards are being introduced such that the speed and frequency of communication over an ethernet LAN will increase. The increase in speed and frequency will cause an increase in the frequency of signal transitions on the ethernet LAN.

Signal transitions in a typical wire cause a current to flow which generates an electromagnetic field about the wire. As the frequency in the signal transitions increase the strength of the electromagnetic field increases. An electromagnetic field around a wire can cause interference to radio-wave signals and even interfere with the signals on adjacent wires thereby causing faulty signals. Thus, increasing the frequency of communication over a LAN brings about an increase in signal transitions and a stronger electromagnetic field around the wires. In the case of 10BASE-T ethernet LAN, the increased signal transitions are introduced into the modular adapter possibly interfering with radio-wave signals external to the modular adapter and the signals propagating on adjacent conductors within the modular adapter. The cable connected to the modular adapter can amplify the electromagnetic radiation like an antenna if the electromagnetic radiation is allowed to propagate down the conductors of the cable and proper shielding is not present.

A modular adapter with the appropriate male or female connectors may be used to adapt from one connector to another other than RJ-45 and D-type connectors. In any case, it is desirable to reduce the electromagnetic interference that may interfere with radio-wave signals and adjacent conductors within a modular adapter.

SUMMARY OF THE INVENTION

It is an object of the present invention to do reduce radio interference that may be caused by electromagnetic radiation emanating from a modular adapter.

Another object of the present invention is to reduce faulty signals on adjacent signal lines that may be caused by electromagnetic radiation emanating within a modular adapter.

Another object of the present invention is to provide flexibility in a modular adapter by providing user programmability.

Briefly, the present invention includes a shielded modular adapter that adapts one type of connector to another and provides electromagnetic shielding therein in order to reduce radio frequency interference and adjacent signal line interference. The shielded modular adapter may include electromagnetic interference filters to further reduce electromagnetic radiation. Additionally, the shielded modular adapter is user programmable or selectable by inserting pins into the appropriate holes within connector and snapping the connector in place.

An advantage of the present invention is that shielding is provided in a modular adapter such that radio frequency interference is reduced.

Another advantage of the present invention is that shielding is provided in a modular adapter such that faulty signals on adjacent signal lines caused by electromagnetic radiation is reduced.

A further advantage of the present invention is that a user may program a modular adapter that also provides electromagnetic shielding.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

The embodiments of the present invention include a programmable shielded modular adapter that provides electromagnetic shielding for a modular adapter. The programmability or selectability of the shielded modular adapter is provided to a user whom may perform the final assembly as desired.

Figure 1:
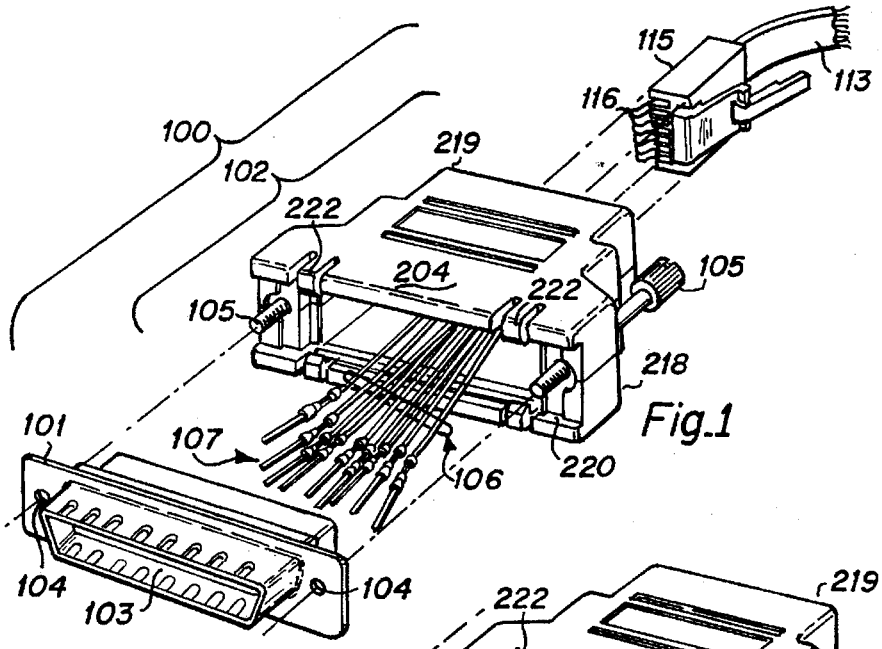
FIG. 1 illustrates a sub-assembly of the first embodiment of the present invention.

FIG. 1 illustrates a subassembly of the first embodiment of the present invention and referred to by the general reference character 100. The shielded modular adapter 100 includes a first connector 101, a body 102, and a second connector (not shown in FIG. 1). The connector 101 is preferably a DB25 (D-type 25 pin) connector including a plurality of holes 103 to receive pins and a pair of screw holes 104 for mounting. The body 102 includes a pair of screws 105 insertable through the screw holes 104. A plurality of insulated wires 106 extend outward from the body 102 and with each wire 106 having a pin 107 coupled at one end. Pins 107 are male pins which are inserted into the holes 103 of the male connector 101 and protrude through the holes 103. However pins 107 may be female pins such that the female pins may be inserted into a female connector. In either case, once the pins 107 are inserted into the appropriate holes 103 they are effectively held in place by a locking mechanism within the connector 101. The pins 107 may be selectively inserted and positioned into the holes 103 of the connector 101 thereby programming the adaptation provided by the shielded modular adapter 100.

Figure 3:
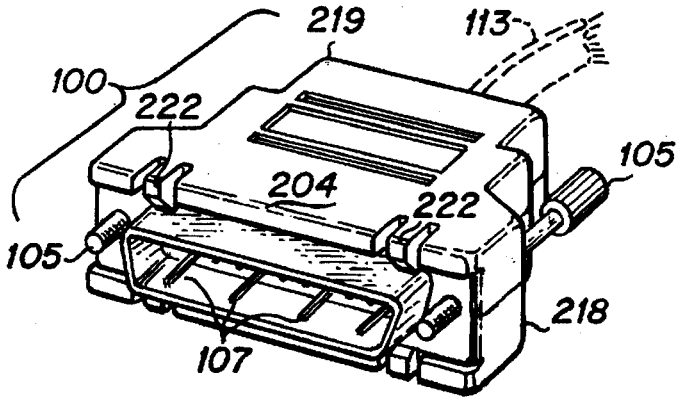
FIG. 3 illustrates an assembled view of the first embodiment of the present invention.
Figure 5:
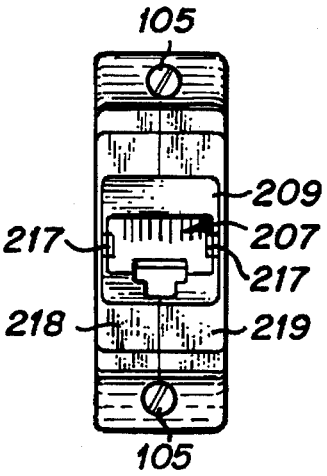
FIG. 5 illustrates a back view of the first embodiment of the present invention.

After pins 107 are inserted into the holes 103 as desired, the connector 101 may be snapped into the body 102 thereby coupling the connector 101 to the body 102 as illustrated in FIG. 3. A cable 113 including a connector 115 may be plugged into the back of the body 102. The back of the body 102 into which the connector 115 may be inserted is illustrated in FIG. 5. The connector 115 is preferably a male RJ-45 modular plug providing eight contacts 116. The cable 113 is preferably a modular cable which is insulated, shielded, and provides multiple (e.g. eight) signal wires.

Figure 2:
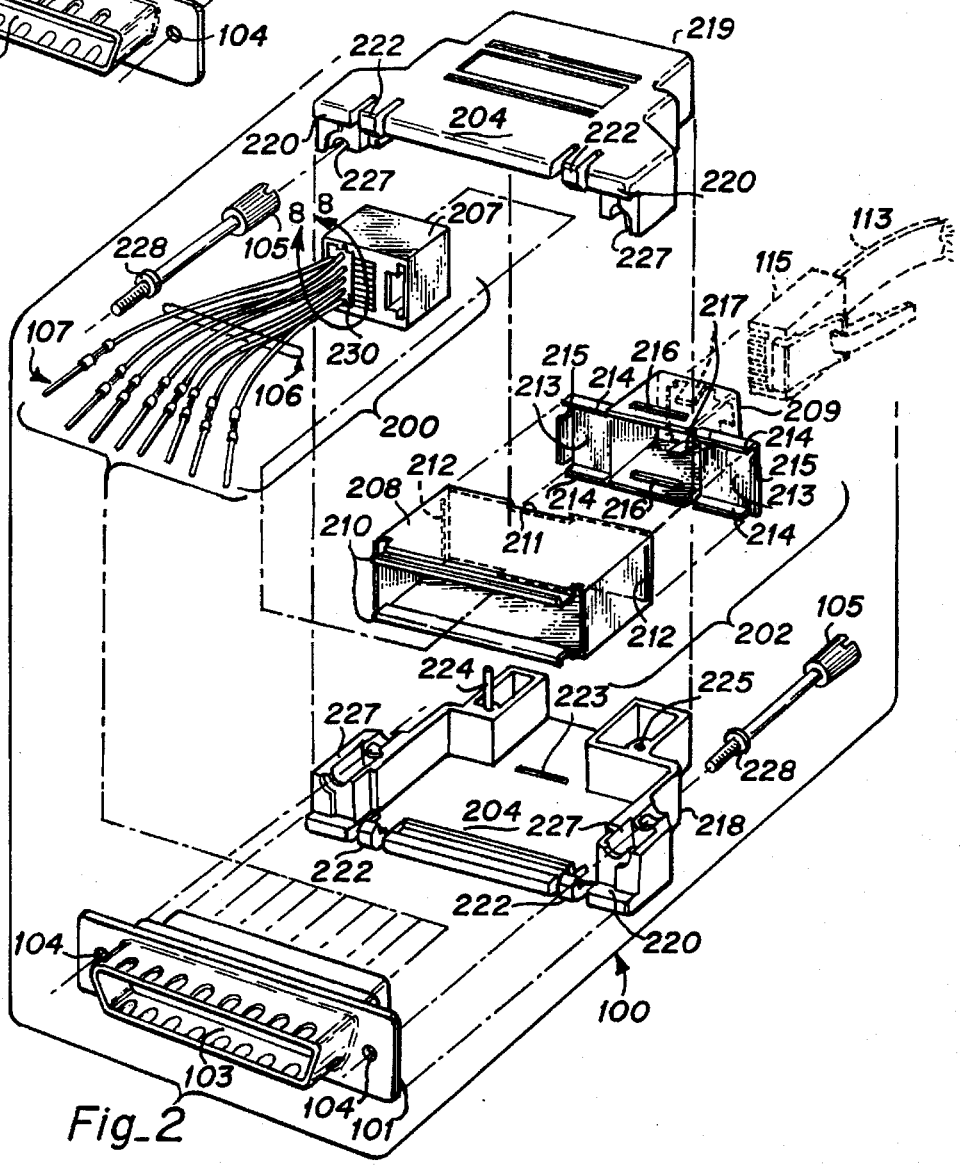
FIG. 2 illustrates an exploded view of the first embodiment of the present invention.

FIG. 2 illustrates an exploded view of the shielded modular adapter 100. The body 102 includes a wire assembly 200, an electromagnetic shield 202, and a protective housing 204. The wire assembly 200 includes insulated wires 106 coupled to pins 107 at one end and a second connector 207 coupled to the opposite end of the wires 106. The second connector 207 is preferably a female RJ-45 modular jack providing eight contacts for the insulated wires 106.

The electromagnetic shield 202 is made of a conductive material such as metal which is formed into rectangular box shapes. The rectangular shape of the shield 202 provides improved shielding and capture of electromagnetic radiation and is preferably nickel plated to further improve its shielding properties. The dimensions of the electromagnetic shield 202 position the shield near the current carrying components of the adapter 100 to dissipate radio interference generated within while protecting the components inside the adapter 100 from external radiating sources. The electromagnetic shield 202 includes a forward section 208 and a rearward section 209.

The forward section 208 is shaped similar to a small hollow rectangular box with an opening at each end. The dimensions of the forward section 208 may be approximately one and;one half inches long at top and bottom, one half inch wide at its sides, and seven-eights inches deep. About the first opening of the section 208 is a pair of flaps 210 on the top and bottom edges that are shaped to couple with the outer casing of the connector 101 which is typically made of metal. The second opening of the section 208 is shaped to couple with the section 209. The top and bottom edges of the second opening include short recessed edges 211. On the sides of the section 208, near the second opening, are narrow rectangular cutouts 212 to receive and couple with the rearward section 209.

The rearward section 209 is shaped similar to an open carton with attached lateral flaps 213 at a first end facing forward section 208. The flaps 213 are shaped to couple to forward section 208 and cover the second opening of the section 208 to further improve the shielding. Each flap 213 includes secondary flaps 214 that couple to the top and bottom surfaces of the forward section 208 and interlocking flaps 215 that couple with the rectangular cutouts 212 of section 208. The rearward section 209 further includes a short narrow depression 216 in the top and bottom surfaces that may couple with the short recessed edges 211 in section 208. The depressions 216 further hold the connector 207 in position with section 209. A back-end opening of section 209 is shaped to allow the connector 115 of the cable 113 (shown ghosted in FIG. 2) to couple to the connector 207. The section 209 at the back-end includes hooks 217 near the edge of the opening for holding and coupling to the connector 207. The open box shape of section 209 substantially surrounds the connector 207 to further improve the shielding. The dimensions of the box shape may be approximately six-eight inches long at top and bottom, nine-sixteenths of an inch wide at the sides and five-eights on an inch deep.

The protective housing 204 may be formed of one piece of material or two pieces of material coupled together. In FIGS. 1–5, the protective housing 204 is two pieces and includes a first half shell 218 and a second half shell 219. The interior portions of the first and second half shells are shaped to surround the sections 208 and 209 of the electromagnetic shield 202. The shells 218 and 219 each include a channel 220 and hooks 222 to couple and hold the connector 101 to the body 102. The shells 218 and 219 are preferably made of a somewhat flexible material such as molded plastic so that the shells and hooks may flex when the connector 101 is snapped in place into the body 102. The shells 218 and 219 may each further include short narrow ridges 223 that couple and interlock with the short narrow depressions 216 in section 209 of the electromagnetic shield 202. For proper assembling of the shells 218 and 219 together, each shell includes a locking pin 224 and an aligned keyhole 225 for proper alignment. A pair of corresponding semi-cylindrical channels 227 in each shell 218 and 219 generate cylindrical channels within the body 102 when shells 218 and 219 are coupled together. The pair of screws 105 extend through the formed channel and provide for mounting and securing the shielded modular adapter 100 to a corresponding connector (not shown). The threads of the screws 105 extend through the holes 104 in the connector 101 when the shielded modular adapter 100 is finally assembled. The screws 105 further couple and hold the connector 101 in the channels 220 restraining the lateral movement of the connector 101 in the body 102. Each screw 105 includes a circular ridge 228 so that it may be retained within the body 102 by the cylindrical channels as illustrated in FIG. 1.

Figure 8:
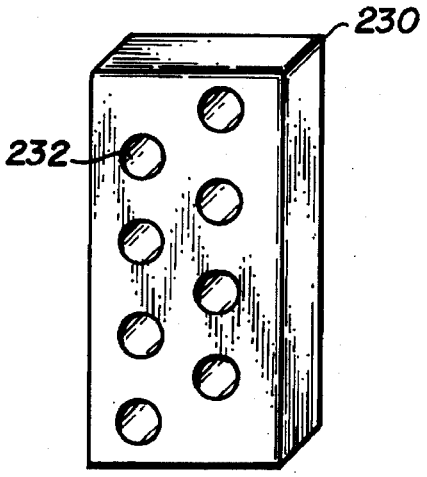
FIG. 8 illustrates a magnified view of the ferrite filter plate.

The shielded modular adapter 100 may further include an electromagnetic interference filter in order to further reduce the electromagnetic radiation. Preferably a ferrite filter comprising a ferrite filter plate 230 may be included in the wire assembly 200 of the shielded modular adapter 100 to further reduce electromagnetic radiation. The ferrite filter plate 230 attenuates radio frequency energy around the frequency of one megahertz. In FIG. 2, the ferrite filter plate 230 is included in the connector 207 and surrounds each of the insulated wires 106. FIG. 8 illustrates the ferrite filter plate 230. The ferrite filter plate 230 has two rows of holes 232 through which the insulated wires 106 may pass. The dimension of a hole 232 is approximately five-one-hundredths on an inch in diameter. The holes 232 are vertically spaced apart by approximately five-one-hundredths on an inch from center to center. The rows of holes 232 are horizontally spaced apart by approximately one-tenth of an inch from center to center. The overall dimensions of the ferrite filter plate are approximately one-fifth of and inch wide, one-half of an inch tall and five-one-hundredths of an inch thick. The ferrite filter plate is preferably made of a chemical composition of MnZn (Manganese and Zinc) materials. Alternatively, other electromagnetic filter types such as a feedthrough filter using a discoidal capacitor array within the connector 101 or a lumped element type filter may be used.

Assembly of the body 102 of the shielded modular adapter 100 may differ depending upon the construction of the housing 204. The housing 204 may be of a molded one piece of material (not shown) such as injection molded plastic or it may be of a two piece design that includes the two shells 218 and 219.

In the case of a two piece housing 204, assembly of the body 102 proceeds as follows. The connector 207 of the wire assembly 200 is inserted into section 209 of the electromagnetic shield 202. Section 208 of the electromagnetic shield 202 is coupled to the section 209 of the electromagnetic shield 202 such that the interlocking flaps 215 are coupled to the narrow rectangular cutouts 212 through the inside of section 208 and the secondary flaps 214 are coupled to the outside of section 208. Sections 208 and 209 of the electromagnetic shield 202 may then be soldered or welded together. The electromagnetic shield 202 now surrounding the wire assembly 200 is inserted into either the shell 218 or 219. The depression 216 in section 209 couples to the ridge 223 in shell 218 or 219. Screws 105 are placed into the shell 218 or 219 such that the ridges 228 fall into the channels 227. A glue or other cement is placed around the inner edges of the shells, pins 224 and keyholes 225. The shells 219 and 218 are positioned with pins 224 aligned with the keyholes 225 and ridges 223 aligned with depressions 216. The shells 218 and 219 are then coupled together and the cement or glue allowed to dry thereby forming the body 102 of the subassembly of the shielded modular adapter 100 as illustrated in FIG. 1. The inner portions of the shells 218 and 219 conform to the outer portions of the electromagnetic shield 202.

In the case housing 204 is of one piece, the assembly of the body 102 proceeds as follows. The electromagnetic shield 202 is assembled similar to that previously described. The inner portions of the one-piece housing are modified from the two-piece housing such that the electromagnetic shield 202 can be pressed into the housing 204 and properly held in place. The electromagnetic shield 202 surrounding the wire assembly 200 is inserted into the front opening of the one piece housing (not shown) back end first and then pressed into place such that the flaps 210 are within the housing 204 and the connector 207 is readily accessible. Screws 105 are screwed through holes in the housing 204 such that the threads are exposed through the channels 227 in the housing and the ridges 228 remain external to the housing 204. No cementing or gluing is necessary.

The final assembly of the shielded modular adapter 100, which provides the programmability or selectability, may be performed by a user or, if standard configurations are desired, the final assembly may be made by the manufacturer. In either case, final assembly may proceed as follows. FIG. 1 illustrates one embodiment as shipped to a user. The pins 107 may be inserted by a user into selected holes 103 of the connector 101 thereby selecting or programming the functionality of the shielded modular adapter 100. Alternatively a wiring configuration may be used by the manufacturer to insert the pins 107 into the holes 103. After the pins 107 are inserted into the holes 103 as desired by the user, the upper or lower edge of the connector 101 is placed into one of the channels 220 in shell 218 or 219 of the body 102 and then the other edge of the connector 101 is snapped into the other channel 220 of body 102 by first flexing the hooks 222 in the shell 218 or 219 and then pushing the edge of the connector into the channel 220. After snapping the connector 101 in place, the shielded modular adapter 100 is then assembled as illustrated in FIG. 3.

Figure 4:
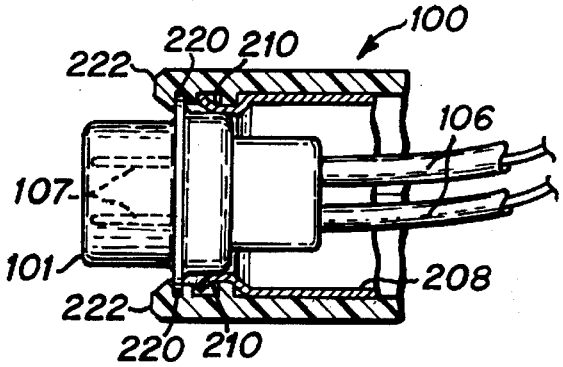
FIG. 4 illustrates a cross-sectional side view of the portion of the first embodiment of the invention.

FIG. 4 illustrates a cross-sectional view of the front portion of the shielded modular adapter 100 after final assembly. The insulated wires 106 are inserted into connector 101 and the connector 101 is snapped into the body 102. Pins 107 are recessed within the connector 101. The upper and lower edges of the connector 101 rest in the channels 220. The connector 101 is held to the body 102 by the hooks 222 and laterally held in place by the housing 204 and the screws 105. To provide proper shielding, the flaps 210 of the forward section 208 of the electromagnetic shield 202 are coupled to the outer conductive casing of the connector 101 which is typically a metallic material.

FIG. 5 illustrates a back view of shielded modular adapter 100 into which the connector 115 may be plugged. The rearward section 209 of the electromagnetic shield 202 substantially surrounds the connector 207 and the connector 115 when it is inserted therein to provide proper electromagnetic shielding. The shells 218 and 219 substantially surround and support the electromagnetic shield 202.

Figure 6:
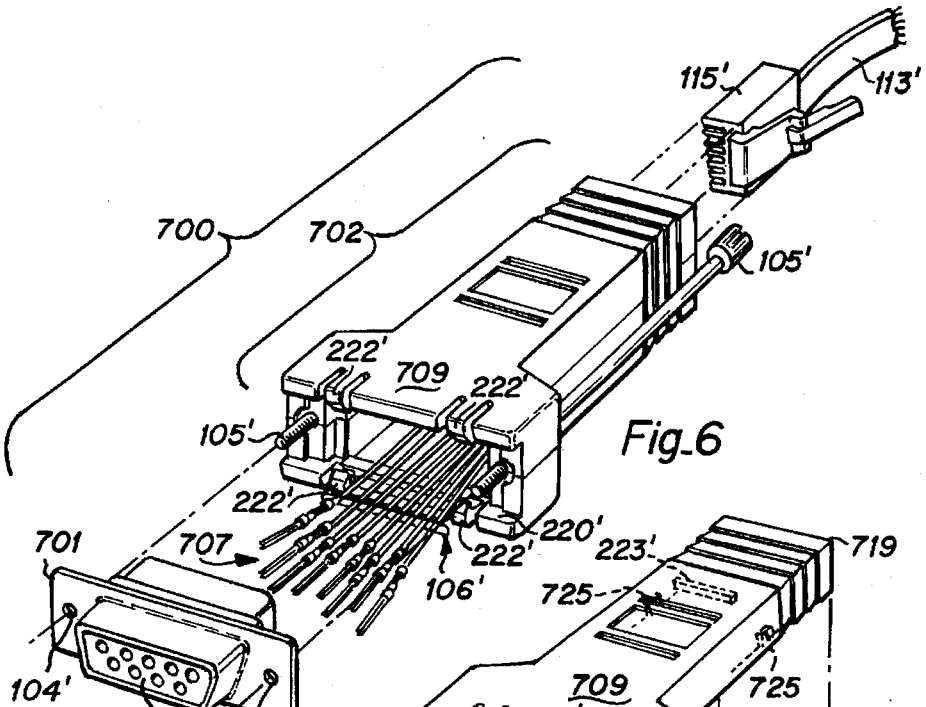
FIG. 6 illustrates a sub-assembly of the second embodiment of the present invention.
Figure 7:
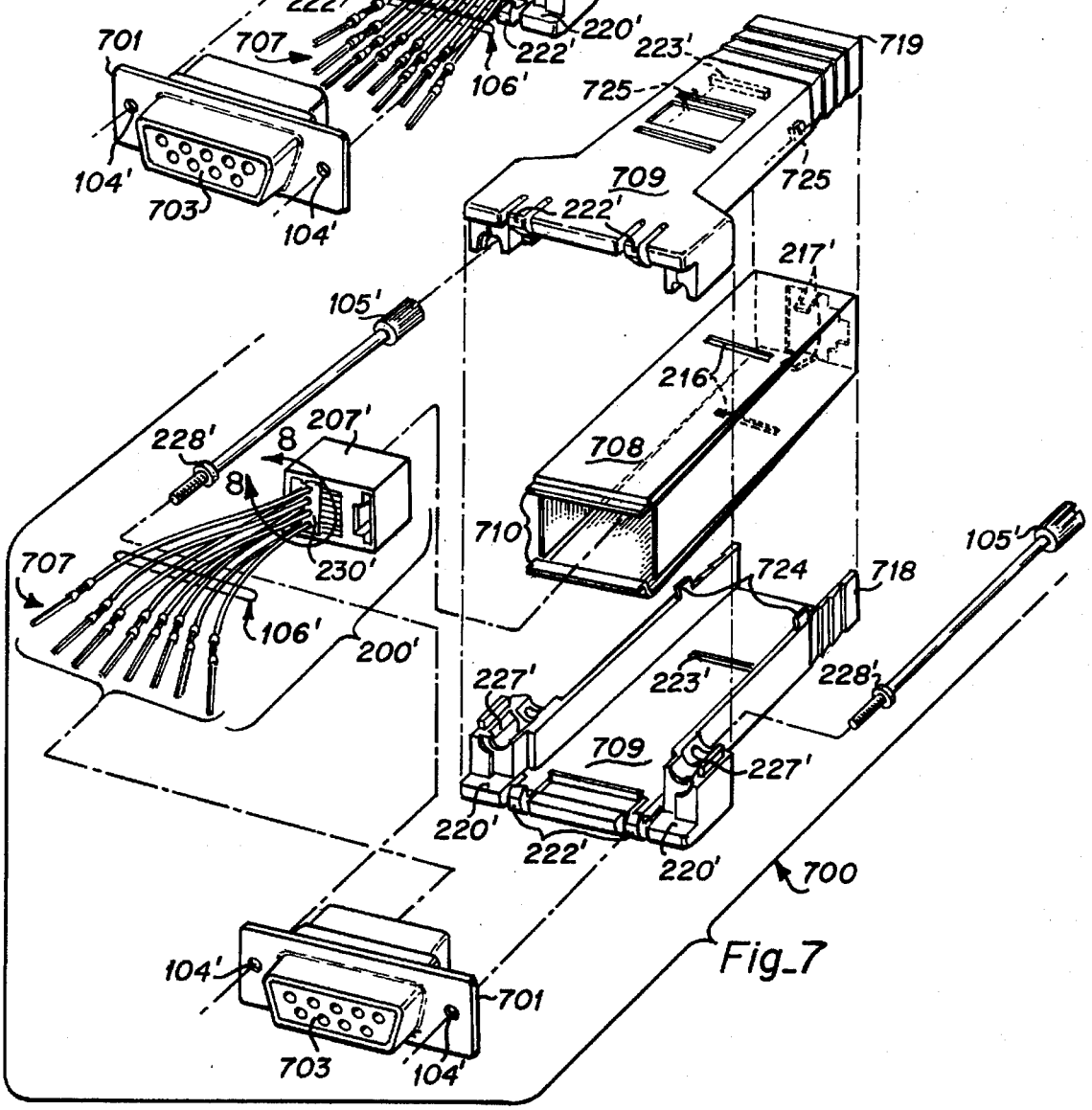
FIG. 7 illustrates an exploded view of the second embodiment of the present invention.

FIGS. 6–7 illustrate a sub-assembly of a second embodiment of the present invention referred to by the general reference designator character 700. Those elements similar to the embodiment 100, carry the same reference number distinguished by a prime designation. The shielded modular adapter 700 includes a first connector 701, a body 702, and the connector 207'. The connector 701 is preferably a DB9 (D-type 9 pin) connector, including a plurality of holes 703 and screw holes 104'. The body 702 includes screws 105' that may be inserted through holes 104'. Insulated wires 106' extend outward from the body 702 and include a plurality of pins 707 coupled at one end of the wires. Pins 707 are adapted for inserting into the holes 703 to form a female connector 701. However, the pins 707 may be male pins and project through the holes 703 to create a male connector 701. In either case, once the pins 707 are inserted into the appropriate holes they are effectively held in place by a locking mechanism within the connector 701. The pins 707 may be selectively inserted into the holes 703 of the connector 701 thereby programming the adaptation provided by the shielded modular adapter 700. After pins 707 are inserted into the holes 103' as desired, the connector 701 may be snapped into the body 702 thereby coupling the connector 701 to the body 702. The cable 113' including the connector 115' may be plugged into the back of the body 702. The back of the body 702 is similar to that illustrated in FIG. 5 for the embodiment 100.

In FIG. 7 body 702 includes the wire assembly 200', an electromagnetic shield 708, and a housing 709. The wire assembly 200' includes insulated wires 106' coupled to the pins 707 at one end and the connector 207' coupled to the opposite end of the wires 106'. As discussed above, the connector 207' is preferably a female RJ-45 modular jack providing eight contacts for the insulated wires 106'.

The electromagnetic shield 708 is preferably made of a conductive material such as metal which is formed into a rectangular box shape. The shape of the electromagnetic shield being rectangular provides improved shielding and capture of electromagnetic radiation. Preferably the electromagnetic shield 708 is nickel plated to further improve its shielding properties.

The electromagnetic shield 708 is shaped similar to a small hollow rectangular box having an opening at each end. The dimensions of the electromagnetic shield 708 may be approximately eleven-sixteenths of an inch long at top and bottom, nine-sixteenths of an inch wide at the sides, and one and seven-eights inches deep. The first opening includes a pair of flaps 710 on the top and bottom edges similar to flaps 210 that are shaped to couple with the outer casing of the connector 708 which is typically made of metal. The electromagnetic shield 708 further includes the short narrow depressions 216' in the top and bottom surfaces for coupling to the housing and holding the connector 207' in place. The second opening of the electromagnetic shield 708 is shaped to allow the connector 115' of the cable 113' to couple to the connector 207'. The electromagnetic shield 708 at the end near the second opening includes hooks 207' near the edge of the opening for holding and coupling to the connector 207'. The rectangular box shape of the electromagnetic shield 708 substantially surrounds the connector 207' to further improve shielding.

The housing 709 may be formed of one piece of material or two pieces of material coupled together. In FIG. 7, the housing 709 is illustrated as two pieces and includes two half shells 718 and 719. The interior portions of the shells 718 and 719 are shaped to surround the electromagnetic shield 708. The housing 709 includes the channel 220' and hooks 222' to couple and hold the connector 701 to the body 702. The housing 709 is preferably made of a somewhat flexible material such as molded plastic so that the housing and hooks 222' may flex when the connector 701 is snapped in place into the body 702. The housing 709 may further include the short narrow ridges 223' that may couple to the short narrow depressions 216' in the electromagnetic shield 708. For proper assembling of the housing 709 together, the shells 718 and 719 include pins 724 and keyholes 725 for proper alignment.

The body 702 includes the screws 105' for holding the shielded modular adapter 700 coupled to a corresponding connector (not shown). The threads of the screws 105' extend through the holes 104' in the connector 701 when the shielded modular adapter 700 is finally assembled. The screws 105' further couple and hold the connector 701 in the channels 220' restraining the lateral movement of the connector 701 in the body 702. The corresponding semi-cylindrical channels 227' generate cylindrical channels within the body 702 when the shells 718 and 719 Of the housing 709 are coupled together. Each screw 105' includes a circular ridge 228' so that it may be retained within the body 702 by the cylindrical channels 227' such as illustrated in FIG. 6.

Similar to the embodiment 100, the shielded modular adapter 700 may further include the electromagnetic interference filter in order to further reduce the electromagnetic radiation. Preferably a ferrite filter comprising the ferrite filter plate 230' may be included in the wire assembly 200' of the shielded modular adapter 700 to further reduce electromagnetic radiation. Alternatively, other electromagnetic filter types such as a feedthrough filter using a discoidal capacitor array within the connector 701 or a lumped element type filter may be used.

Assembly and programming of the shielded modular adapter 700 is similar to the assembly and programming of the embodiment 100. The main difference is that the electromagnetic shield 708 is one piece and avoids having to assemble the forward section 208 and the rearward section 209 of the electromagnetic shield 202 together.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A shielded modular adapter (100) for reducing electromagnetic interference and coupling a modular cable (113) having a first modular connector (115) to another connector, the shielded modular adapter comprising:

a second modular connector (207) for coupling to the first modular connector (115) of the modular cable (113);

a plurality of insulated wire cables (106) coupled at a first end to the second modular connector (207);

a plurality of pins (107 or 707) coupled to a second end of the plurality of insulated wire cables (106);

an electromagnetic shield (202 or 708) substantially surrounding the second modular connector (207) and the plurality of insulated wire cables (106) for reducing electromagnetic interference;

a third connector (101 or 701) with a plurality of pin holes (103 or 703) to receive the plurality of pins (107 or 707) and for electrically coupling to the electromagnetic shield (202 or 708); and a housing (204 or 709) coupled to the electromagnetic shield (202 or 708) and the third connector (101 or 701), the housing having a first and second opening, the first opening for exposing the electromagnetic shield (202 or 708) and the second modular connector (207) and the second opening including top and bottom edges having hooks (222) for accepting and coupling the third connector (101 or 701) to the housing (204 or 709).

2. The shielded modular adapter of claim 1 further comprising means for securing the third connector (101) to the housing (204 or 709) and electrically coupling the third connector (101 or 701) to the second modular connector (207).

3. The shielded modular adapter of claim 2 wherein the third connector (101 or 701) is a D-type connector.

4. The shielded modular adapter of claim 3 wherein the third connector (101) is a twenty-five pin D-type connector.

5. The shielded modular adapter of claim 3 wherein the third connector (701) is a nine pin D-type connector.

6. The shielded modular adapter of claim 1 wherein the second modular connector (207) is an RJ-45 jack.

7. The shielded modular adapter of claim 1 wherein the second modular connector (207) is an RJ-11 jack.

8. The shielded modular adapter of claim 1 wherein the housing (204 or 709) comprises a pair of shell halves (218 and 219 or 718 and 719) coupled together.

9. The shielded modular adapter of claim 1 further comprising a first and second screw (105) coupled to the housing (204) for coupling and aligning the third connector (101 or 701) coupled to the housing (204).

10. The shielded modular adapter of claim 1 further comprising a plurality of electromagnetic interference filters electrically coupled to the plurality of insulated wire cables (106) and the plurality of pins (107).

11. The shielded modular adapter of claim 1 wherein the plurality of electromagnetic interference filters are ferrite filters (230).

12. The shielded modular adapter of claim 1 wherein the electromagnetic shield (202 or 708) is made of a nickel coated conductive metallic material.

13. The shielded modular adapter of claim 1 wherein the electromagnetic shield (708) further comprises a pair of flaps (710) for electrically coupling the electromagnetic shield (708) to the third connector (701).

14. The shielded modular adapter of claim 13 wherein the housing (709) further comprises a pair of ridges (223') for coupling to and holding the electromagnetic shield (708)

and wherein, the electromagnetic shield (708) further comprises a pair of depressions (216') for coupling to said ridges (223') of the housing (709), and a pair of hooks (217') for coupling to and holding the second modular connector (207') to the electromagnetic shield (708).

15. The shielded modular adapter of claim 1 wherein the electromagnetic shield (202) comprises a first section (208) and a second section (209) coupled together.

16. The shielded modular adapter of claim 15 wherein said first section (208) of the electromagnetic shield (202) further comprises a pair of flaps (210) for electrically coupling the electromagnetic shield (202) to the third connector (101).

17. The shielded modular adapter of claim 15 wherein said first section (208) of the electromagnetic shield (202) further comprises a pair of cutouts (212) for coupling to said second section (209) of the electromagnetic shield (202), and wherein, said second section (209) of the electromagnetic shield (202) further comprises a pair of interconnecting flaps (215) for coupling to said pair of cutouts (212) and holding said first section (208) coupled to said second section (209), and flaps (214) coupled to said first section (208) for further reducing electromagnetic interference.

18. The shielded modular adapter of claim 15 wherein the housing (204) further comprises a pair of ridges (223) for coupling to and holding the electromagnetic shield (202)

and wherein, said second section (209) of the electromagnetic shield (202) further comprises a pair of depressions (216) for coupling to said ridges (223) of the housing (204), and a pair of hooks (217) for coupling to and holding the second modular connector (207) to the electromagnetic shield (202).

19. A method for programming and completing assembly of a shielded modular adapter, the steps comprising:

a) providing a subassembly of a shielded modular adapter (100) comprising a first connector (207) for coupling to a modular cable (113);

a plurality of insulated wire cables coupled at a first end to the first connector (207);

a plurality of pins (107 or 707) coupled to a second end of the plurality of insulated wire cables (106);

an electromagnetic shield (202 or 708) substantially surrounding the first connector (207) and the plurality of insulated wire cables (106) for reducing electromagnetic interference;

a second connector (101 or 701) with a plurality of pin holes (103 or 703) to receive the plurality of pins (107 or 707); and a housing (204 or 709) coupled to the electromagnetic shield (202 or 708), the housing (204 or 709) having a first and second opening, the first opening for exposing the electromagnetic shield (202 or 708) and the first connector (207) and the second opening including top and bottom edges having hooks (222) for accepting and coupling the second connector (101 or 701) to the housing (204 or 709);

b) inserting the plurality of pins (107 or 707) coupled to the second end of the plurality of insulated wire cables (106) into the second connector (101 or 701) in a predetermined order thereby programming the shielded modular adapter (100); and c) coupling the second connector (101 or 707) to the housing of the subassembly of the shielded modular adapter (100) thereby completing assembly of the shielded modular adapter (100).

20. The method of claim 19 for programming and completing assembly of the shielded modular adapter, the steps further comprising:

a) providing a subassembly of the shielded modular adapter (100) that further comprises screws (105) coupled to the housing (204 or 709);

and b) aligning screw holes (104) in the second connector (101 or 701) with the screws (105) coupled to the housing (204 or 709) prior to coupling the second connector (101 or 701) to the housing (204 or 709).

* * * * *

Disclaimer 5,628,653—Orville A. Haas, Pocahontas, Ark.; Edward A. Karale, Fremont, Calif. SHIELDED MODULAR ADAPTER. Patent dated May 13, 1997. Disclaimer filed Dec. 5, 1997, by the assignee, Regal Electronics, Inc.

Hereby enters this disclaimer to claim 1—20 of said patent.

*(Official Gazette,* February 24, 1998)